US005735137A

United States Patent [19]

Kim

[11] Patent Number: 5,735,137

[45] Date of Patent: Apr. 7, 1998

[54] SUCTION INLET OPENING OR CLOSING APPARATUS FOR AN AIR CONDITIONER

[75] Inventor: Jong-Lae Kim, Paldal-gu, Rep. of Korea

[73] Assignee: Samsung Electronics Co., Ltd., Suwon, Rep. of Korea

[21] Appl. No.: 783,546

[22] Filed: Jan. 14, 1997

[30] Foreign Application Priority Data

Mar. 21, 1996 [KR] Rep. of Korea ..... 96-7782

[51] Int. Cl.[6] ..... F25D 17/04

[52] U.S. Cl. ..... 62/410; 454/351; 454/352

[58] Field of Search ..... 62/408, 409, 410, 62/411; 454/233, 234, 351, 352

[56] References Cited

U.S. PATENT DOCUMENTS 2,006,069 6/1935 Day ..... 62/408

3,431,748 3/1969 Bolton ..... 62/408

4,522,255 6/1985 Baker ..... 454/233

5,187,949 2/1993 Jung-Il et al. ..... 62/411

FOREIGN PATENT DOCUMENTS 32242 2/1988 Japan ..... 454/233

*Primary Examiner*—William Doerrler

*Attorney, Agent, or Firm*—Burns, Doane, Swecker & Mathis, L.L.P.

[57] ABSTRACT

An air conditioner includes an air inlet, an air outlet, a heat exchanger, and a suction source for sucking-in air through the inlet and then discharging the air through the outlet after passing the air across the heat exchanger. Vanes are provided for opening and closing the inlet. A drive mechanism rotates the vanes about respective horizontal axes such that the vanes become opened by progressively greater amounts in a direction away form the suction source to expose progressively larger areas of the air inlet. This achieves a substantially uniform rate of air flow throughout the height of the air inlet.

6 Claims, 5 Drawing Sheets

SUCTION INLET OPENING OR CLOSING APPARATUS FOR AN AIR CONDITIONER

BACKGROUND OF THE INVENTION

1. Field of the Invention

The present invention relates to an air conditioner and, more particularly to a suction inlet opening or closing apparatus for an air conditioner.

2. Description of the Prior Art

As shown in FIG. 1, a conventional air conditioner has a front panel 3 provided at a front surface of a main body 1 forming the external appearance of the air conditioner, a suction inlet 5 integrally provided below the front panel 3 for taking in a room air into the body 1, and a discharge outlet 7 provided over the front panel 3 for discharging indoors the air heat-exchanged by a heat-exchanger(not shown) which serves to heat-exchange the air sucked through the suction inlet 5 with cold or warm refrigerant.

The front panel 3 has at a lower portion thereof a control panel 9 for establishing desired operation conditions such as high or low level in cooling or heating, operation period of time, and the like.

Also, air directing 13 and 15 are provided in the discharge outlet 7 for respectively defining horizontal and vertical directions in which the heat-exchanged air is discharged indoors through the discharge outlet 7.

The suction inlet 5 is provided with a suction grille member 11 formed in a flat plate for protecting the suction inlet 5. Upon a rear portion of the suction grille member 11 is mounted a filtering member(not shown) which is used for filtering any foreign substances contained in the air sucked through the suction inlet 5. The suction grille member 11 is also provided in a front surface thereof with suction openings 11*a* which communicate with the suction inlet 5.

Referring to FIG. 2, the suction grille member 11 also has projections 11*b* at respective upper and lower portions thereof, which occurence of each a projection being fitted to a recess 1*a* correspondingly formed in the body 1. The suction grille member 11 having projections 11*b* can be detached from the body 1, for replacing the filtering member (not shown) a new one or cleaning thereof.

The conventional air conditioner as described above is operated under the control of control means, not illustrated, in response to commands from the operation manipulating portion 9.

The room air is sucked into the body 1 through the plurality of suction openings 11*a* formed at the suction grille member 11, heat-exchanged by the heat-exchanger, and then discharged into the discharge outlet 7 by blowing means(not shown) for heating or cooling the room air.

It can be seen from the drawings that the suction inlet 5 is partially covered with the suction grille member 11 except for the suction openings 11*a* provided therein. All suction openings 11*a* through the suction inlet 5 have the same dimension, which results in non-uniformity of the suction speed of the room air, i.e., the air speed through the upper suction openings located closer to the suction source is faster than that through the lower suction openings. This results in a non-uniform distribution of the room air to heat-exchanger, and a reduced efficiency of the air conditioning.

Furthermore, the suction openings 11*a* always remain opened even in the off mode of the air conditioner, thus foreign materials contaminating an interior of the body 1 can be introduced thereinto through the openings 11*a*.

SUMMARY OF THE INVENTION

Therefore, it is an object of the present invention to provide a suction inlet opening or closing apparatus for an air conditioner in which a uniform distribution of sucked air through a heat-exchanger can be made through adjustment of the suction speed of the room air, for improving efficiency of the air conditioner. Furthermore, introduction of foreign substances through the suction inlet into the air conditioner can be prevented during an off mode of the air conditioner.

The above objects are accomplished by a suction inlet opening or closing apparatus for an air conditioner, the apparatus comprising:

- a plurality of suction grille means, each being of a blade type, for opening or closing a suction inlet arranged in such manner that a suction speed is gradually increased from top to bottom of the suction inlet;
- first and second supporting means operatively coupled to both ends of the respective suction grille means for ensuring a vertical swing thereof;
- a plurality of pinions, each being coupled to the respective suction grille means, and each having different gear ratios such that each suction grille means is opened with a different angle range;
- a rack gear engaged with the pinions such that all pinions are driven in a forward or reverse direction;
- a driving pinion engaged with the rack gear, for vertically moving the rack gear; and
- driving means for a forward or reverse rotation of the driving pinion.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

Figure 1:
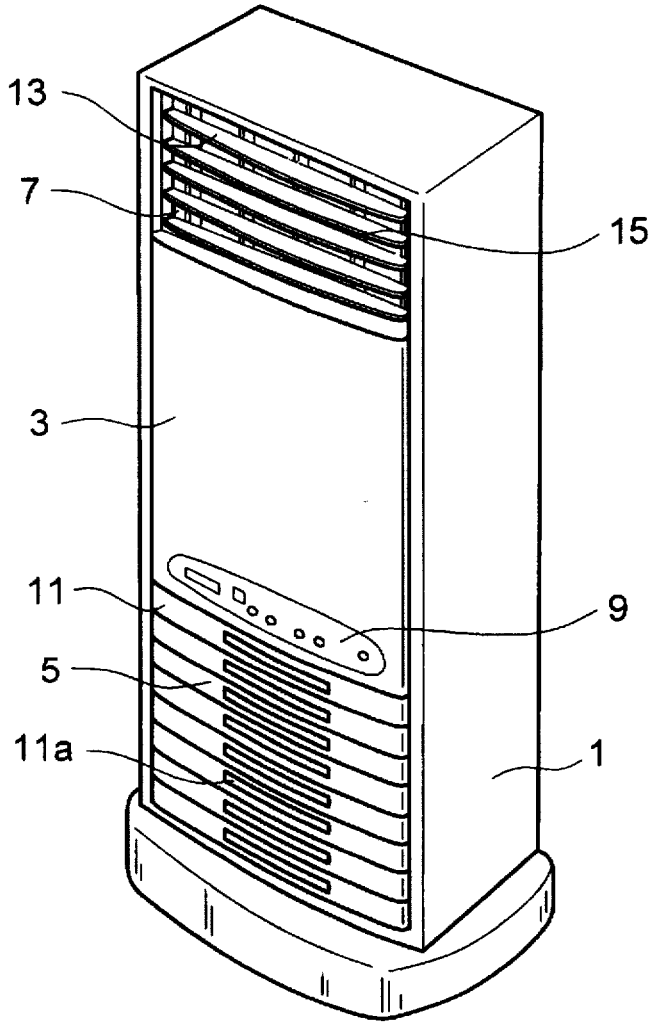
FIG. 1 (PRIOR ART)
FIG. 1 is a perspective view of a conventional air conditioner.
Figure 2:
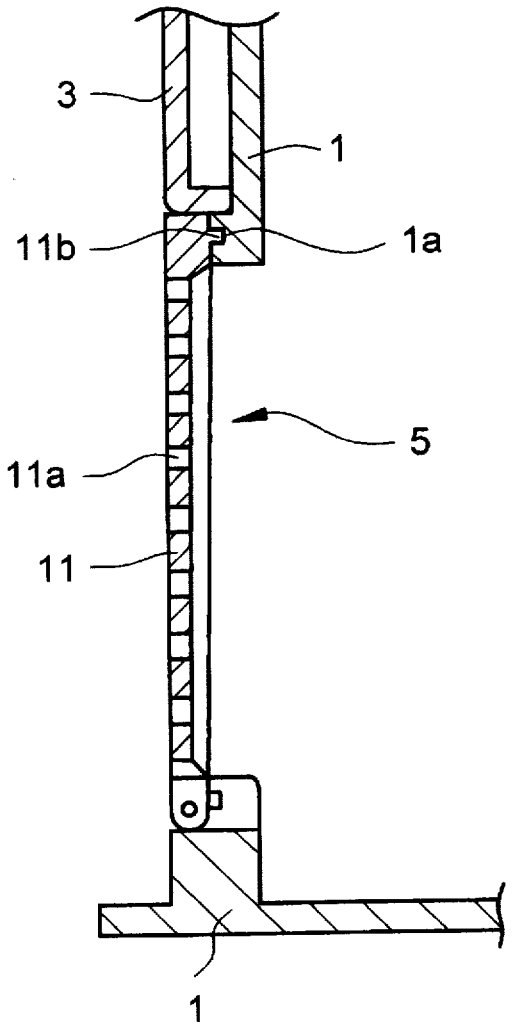
FIG. 2 (PRIOR ART)
FIG. 2 is a vertical sectional view of a suction grille member in FIG. 1.

The preferred embodiment according to the present invention will now be described in detail with reference to FIGS. 3 to 5.

In the drawings, reference numeral 40 denotes a suction inlet opening or closing apparatus for an air conditioner according to the present invention by which a uniform distribution of a sucked air through a heat-exchanger can be effected.

Figure 3:
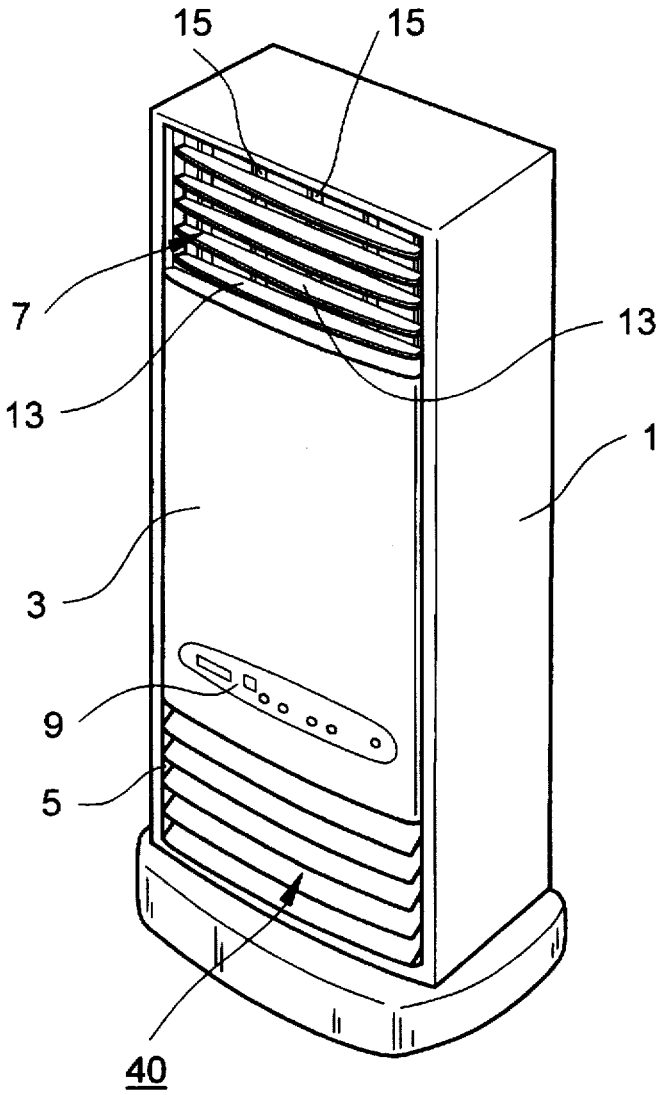
FIG. 3 is a perspective view of an air conditioner according to the present invention.
Figure 4:
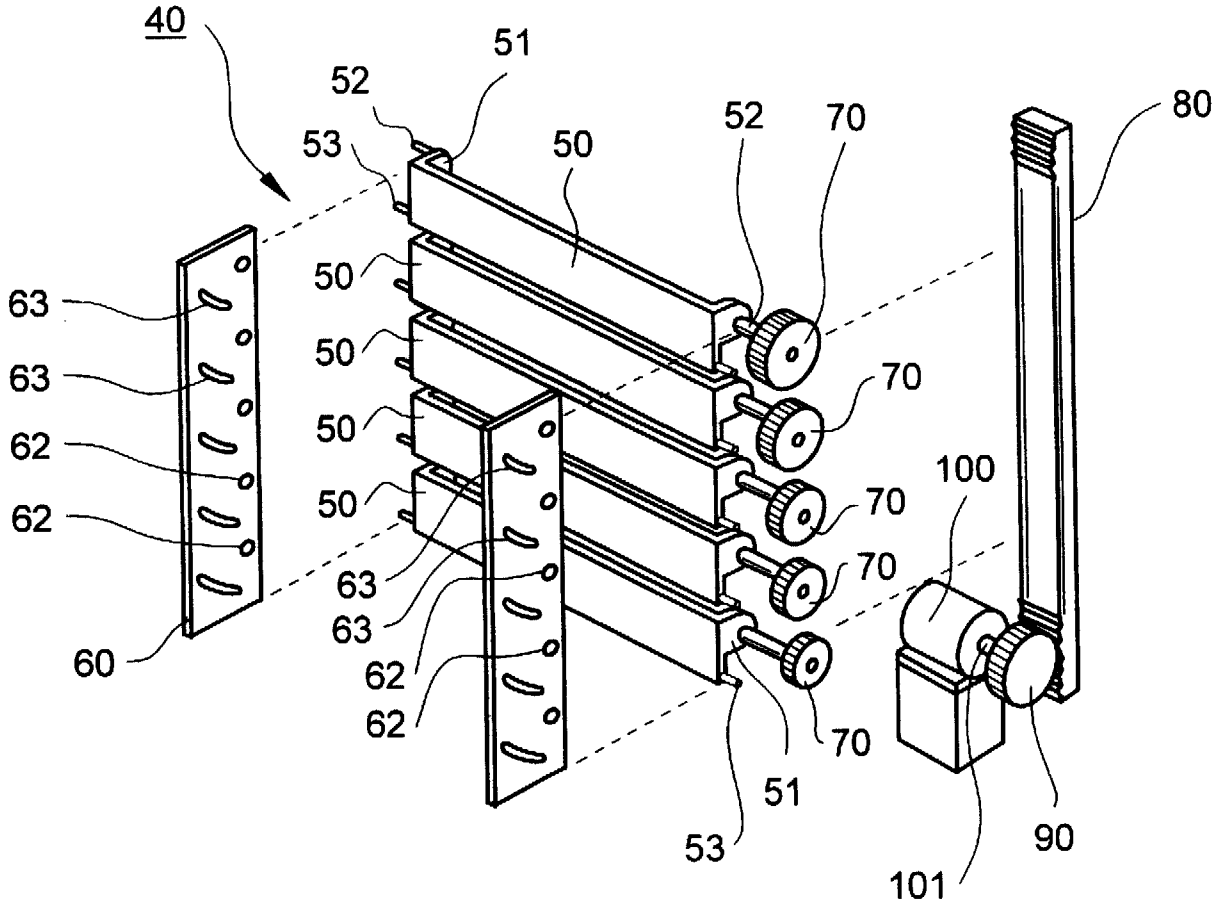
FIG. 4 is a partially exploded perspective view of a suction inlet in FIG. 3.
Figure 5:
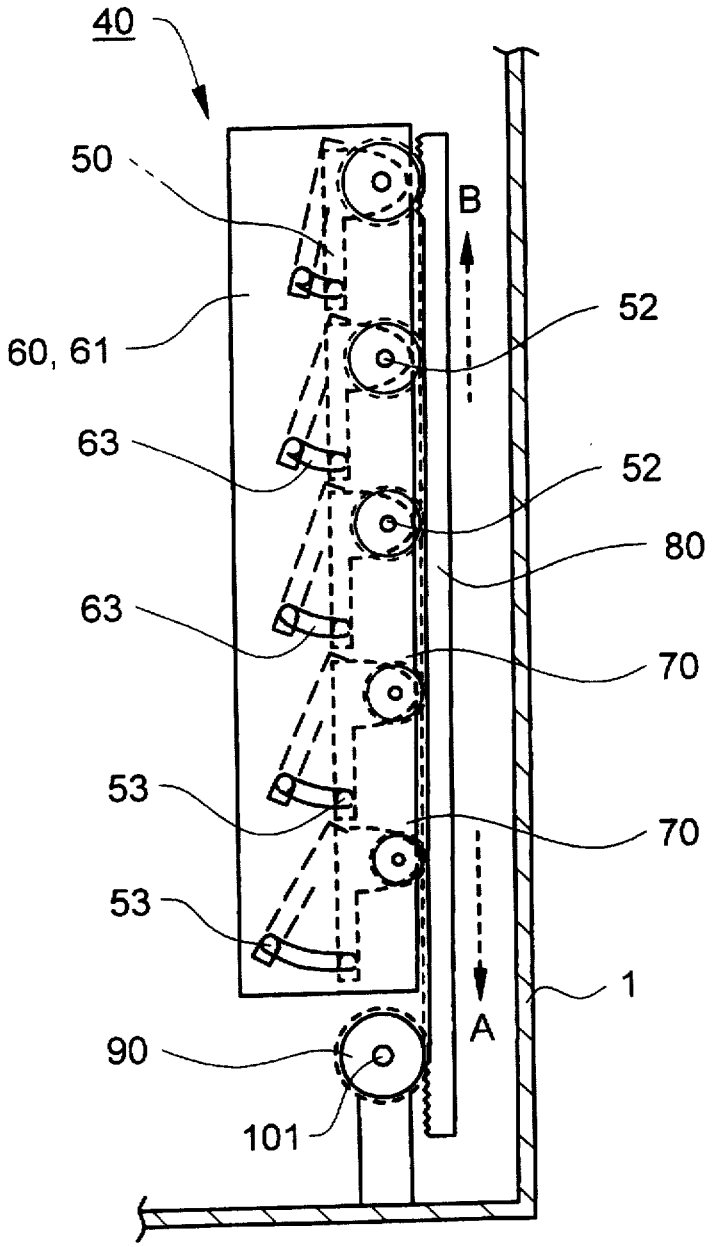
FIG. 5 is a side sectional view showing an operation of the apparatus according to the present invention.

The suction inlet opening or closing apparatus 40 includes, as shown in FIGS. 3 to 5, a plurality of suction grille vanes 50, each end of which is hinged on a respective side of a suction inlet 5 for defining a horizontal axis permitting a vertical swing of each vane 50 for adjusting the sizes of the suction inlet 5 in such a manner that a uniform suction air speed is established from top to bottom of the suction inlet 5 to thereby take in a uniform amount of a room air at each vane 50 first and second supporting plates 60, 61 are air attached on both sides of the suction inlets 5 and operatively coupled to both ends of the suction grille vanes 50, for ensuring a vertical swing of each of the suction grille vanes 50, pinions 70, each being coupled to both ends of the suction grille vanes 50, and each having different gear ratios such that each suction grille vane 50 is swung with a different angle range, a, rack gear 80 for affecting a forward or reverse drive of each pinion is engaged with the all pinions 70. A driving pinion is 90 is engaged with the rack gear 80, for vertically moving the rack gear 80, a motor 100 having a drive shaft 101 is coupled to the driving pinion 90 for a forward or reverse rotation thereof.

The suction grille vanes 50 are provided on both ends thereof with a flange 51 which may be formed, for example, by forwardly bending the ends of each flange 51 with a bending angle of 90-degree, wherein each flange 51 carries two projections 52, 53 on an outer surface thereof. The first projection 52 is externally extended to the pinion 70 with the first and second supporting plates 60, 61 interposed between the flange 52 and the pinion 70, the second projection 53 is externally extended into the first and second supporting plates 60, 61.

Each of the first and second supporting plates 60, 61 has first holes 62 which are vertically disposed with a constant spacing therebetween, respectively, for inserting the first projection 52 acting as a pivot for the suction grille means 50, and elongated second holes 63 for inserting the second projections 53 such that projection 53 can travel within the hole 62.

It is noted that the second holes 63 in the supporting means 60, 61 form an arc for permitting a swing motion of the inserted second projections 53 and configured such that each size thereof is gradually increased from a top hole to a bottom hole.

The pinion 70 sized to have smaller gear ratio is disposed underneath the pinion of a larger gear ratio. These pinions 70 are coupled to the respective first projections 52 on suction grille vanes 50.

Next, the operation and advantage of such a constructed apparatus according to the present invention will be described.

In case a user manipulates the control panel 9 to operate the air conditioner, blowing means(not shown) and the suction inlet opening or closing apparatus in the air conditioner start to operate. The electric power is then supplied to the driving motor 100 of the apparatus 40 to drive the motor 100 in either rotational direction. Then, the drive force of the motor 100 is transmitted to the shaft 101 to which the pinion 90 is coupled to be rotated by the driven shaft 101. The rotation of the pinion 90 causes the rack 80 to descend in this case, as illustrated by an arrow A in FIG. 5.

According to this operation, the pinions 70 engaged with the rack 80 are driven in the same rotational direction as that of the driving pinion 90. Each driven pinion 70 rotates its first projection 52 which causes the vane 50 to be swung in an up direction, which is illustrated by one-dotted line in FIG. 5. This results in the opening of the suction inlet 5 with a given range.

At this time, the second projection 53 on the suction grille vane 50 travels along the perforated second hole 63 and functions to prevent the moving suction grille vane 50 from drifting and to limit the opening range of the suction grille vane 50.

Since a pinion 70 of a smaller gear ratio is disposed underneath a pinion 70 of a larger gear ratio, the upstream each pinion 70 is slowly rotated as compared with the next lower pinion 70 during the descent of the rack 80. It can be seen that the suction inlet 5 becomes progressively open to a greater degree in a direction away from the suction source. Therefore, a uniform suction of the room air can be made throughout the height of the suction inlet, by which a uniform distribution of room air is supplied to the heat-exchanger, allowing the heat-exchanging performance and the resulting cooling or heating efficiency to be improved.

The closing of the suction inlet 5 can be accomplished by the reverse drive of the driving motor 100 of the suction inlet opening or closing apparatus 40. The reverse drive of the driving means 100 allows the driving pinion 90 to be driven in a reverse direction, followed by the ascent of the rack gear 80. Therefore, each pinion 70 is reversely rotated which rotates each first projection 52 allowing the vanes 50 to be swung in a down direction, which is illustrated by one-dotted line in FIG. 5. This results in the closing of the suction inlet 5.

The closing of the suction inlet 5 prevents foreign material contained in the room air from passing into the body 1 through the suction inlet 5 during the stand-by state of the air conditioner, and maintains the clean interior of the air conditioner.

What is claimed is:

1. In a room air conditioner comprising an air inlet, an air outlet, a heat exchanger, and a suction source for sucking-in room air through the air inlet and discharging the air through the air outlet after directing the air across the heat exchanger; the improvement comprising:

means for opening and closing the air inlet including:

a plurality of vertically adjacent vanes arranged across the air inlet and being rotatable about respective horizontal axes between open and closed positions; and a drive mechanism operably connected to the vanes for opening the vanes by progressively greater amounts in a direction away from the suction source to expose progressively larger areas of the air inlet in order to achieve a substantially uniform rate of air flow throughout the height of the air inlet, the drive mechanism including pinions connected to respective vanes for rotating the vanes, the pinions having different gear ratios for rotating the vanes through progressively greater angles.

2. The room air conditioner according to claim 1 wherein the gear ratios become progressively smaller in a direction away from the suction source.

3. The room air conditioner according to claim 1 wherein the drive mechanism further includes a rack gear engageable with all of the pinions for rotating all pinions simultaneously, and a motor for reciprocating the rack gear.

4. The room air conditioner according to claim 3 wherein each vane carries a first projection forming an axis of rotation, and a second projection engageable with a respective stop when the vane reaches its open position.

5. The room air conditioner according to claim 3 wherein each vane carries a projection which travels in a stationary arc-shaped guide slot.

6. The room air conditioner according to claim 1 wherein the air inlet is located at a lower portion of the air conditioner and the air outlet is located at an upper portion of the air conditioner.

* * * * *